US011458489B2

(12) United States Patent
Wang et al.

(10) Patent No.: US 11,458,489 B2
(45) Date of Patent: Oct. 4, 2022

(54) SHOWER WITH ADJUSTABLE WATER SPRAY

(71) Applicant: Xiamen Lota International Co., Ltd., Fujian (CN)

(72) Inventors: Xuedong Wang, Fujian (CN); Jianmin Zhuang, Fujian (CN); Jiangcheng Zhang, Fujian (CN); Chuanbao Zhu, Fujian (CN)

(73) Assignee: XIAMEN LOTA INTERNATIONAL CO., LTD., Fujian (CN)

( * ) Notice: Subject to any disclaimer, the term of this patent is extended or adjusted under 35 U.S.C. 154(b) by 134 days.

(21) Appl. No.: 17/019,780

(22) Filed: Sep. 14, 2020

(65) Prior Publication Data

US 2021/0078020 A1 Mar. 18, 2021

(30) Foreign Application Priority Data

Sep. 12, 2019 (CN) ..... 201921525310.X

(51) Int. Cl.
*B05B 1/18* (2006.01)
*B05B 1/12* (2006.01)
*B05B 1/30* (2006.01)

(52) U.S. Cl.
CPC ..... *B05B 1/185* (2013.01); *B05B 1/12* (2013.01); *B05B 1/3086* (2013.01)

(58) Field of Classification Search
CPC .. B05B 1/12; B05B 1/18; B05B 1/185; B05B 1/3033; B05B 1/3086
See application file for complete search history.

(56) References Cited

U.S. PATENT DOCUMENTS 1,830,694 A * 11/1931 Fraser ..... B05B 1/3086 239/557
2,968,443 A * 1/1961 Manning ..... B05B 1/3086 239/117
3,013,729 A * 12/1961 McLean ..... B05B 1/3086 239/452
3,547,352 A * 12/1970 Hadsel ..... B05B 1/3447 239/602
3,967,783 A * 7/1976 Halsted ..... B05B 1/169 239/447
3,995,812 A * 12/1976 Anderson ..... B05B 1/3086 239/562

(Continued)

*Primary Examiner* — Darren W Gorman
(74) *Attorney, Agent, or Firm* — Cooper Legal Group LLC

(57) ABSTRACT

A shower with an adjustable water spray comprises a body portion and an adjusting member. The body portion comprises a water inlet passage and a plurality of water outlet nozzles. The adjusting member comprises a plurality of adjusting portions, and an outer side of each of plurality of adjusting portions comprises a plurality of adjusting grooves extending longitudinally. A size of each of the plurality of adjusting grooves gradually reduces in a downward direction. An inner wall of each of the plurality of water outlet nozzles comprises a sealing portion, and each of plurality of adjusting portion extends into a corresponding one of the plurality of water outlet nozzles and hermetically and movably cooperates with a corresponding one of the sealing portions. The plurality of adjusting grooves of each of the plurality of adjusting portions and a corresponding one of the sealing portions defines an adjustable water outlet hole.

7 Claims, 10 Drawing Sheets

(56) References Cited

U.S. PATENT DOCUMENTS 6,378,790 B1 * 4/2002 Paterson ..... B05B 17/0692
137/853
8,511,587 B2 * 8/2013 Miller ..... B05B 1/3086
239/548
8,770,495 B2 * 7/2014 Chen ..... B05B 1/3086
239/548

* cited by examiner

SHOWER WITH ADJUSTABLE WATER SPRAY

RELATED APPLICATIONS

This application claims priority to Chinese patent application number 201921525310.X, filed on Sep. 12, 2019. Chinese patent application number 201921525310.X is incorporated herein by reference.

FIELD OF THE DISCLOSURE

The present disclosure relates to a shower with an adjustable water spray.

BACKGROUND OF THE DISCLOSURE

The existing showers generally comprise an ordinary water passage and an adjustable water passage, and the water passages are switched to achieve adjustment function by a valve. Due to the presence of multiple water passages, a size of the showers or the faucets are increased and the structures are complicated. It is necessary to improve the existing showers with an adjustable water spray.

BRIEF SUMMARY OF THE DISCLOSURE

The present disclosure provides a shower with an adjustable water spray to overcome the deficiencies of the existing techniques.

In order to solve the aforementioned technical problem, a technical solution of the present disclosure is as follows.

A shower with an adjustable water spray comprises a body portion comprising a water inlet passage and a plurality of water outlet nozzles and an adjusting member. The adjusting member is movably disposed in the body portion. The adjusting member comprises a plurality of adjusting portions, and an outer side of each of the plurality of adjusting portions comprises a plurality of adjusting grooves extending longitudinally. A size of each of the plurality of adjusting grooves gradually reduces in a downward direction. An inner wall of each of the plurality of water outlet nozzles comprises a sealing portion, and each of the plurality of adjusting portions extends into a corresponding one of the plurality of water outlet nozzles and hermetically and movably cooperates with a corresponding one of the sealing portions. The plurality of adjusting grooves of each of the plurality of adjusting portion and a corresponding one of the sealing portions defines an adjustable water outlet hole. When the plurality of adjusting portions move to a first position, the adjustable water outlet holes have a first size, and water from the water inlet passage flows out of the adjustable water outlet holes to define a water spray having a first strength. When the plurality of adjusting portions move to a second position, the adjustable water outlet holes have a second size, and water from the water inlet passage flows out of the adjustable water outlet holes to define a water spray having a second strength different than the first strength.

In a preferred embodiment, each of the plurality of adjusting portions is a cylinder, and the plurality of adjusting grooves are annularly disposed at intervals on the outer side of each of the plurality of adjusting portions. The sealing portions are annular gaskets, and each of the annular gaskets hermetically surrounds the outer side of a corresponding one of the plurality of adjusting portions.

In a preferred embodiment, the shower with the adjustable water spray further comprises a transmission assembly. The transmission assembly is operatively connected to the adjusting member to drive the adjusting member to move upward and downward.

In a preferred embodiment, the transmission assembly comprises a ballpoint pen button structure disposed on the body portion. The ballpoint pen button structure comprises a button, a lower gear shaft, an upper gear shaft, a lower gear shaft reset member, and a button reset member. The button is operatively engaged with the lower gear shaft, the lower gear shaft is operatively engaged with the upper gear shaft, and the upper gear shaft is operatively engaged with the adjusting member. The lower gear shaft reset member is disposed between and abuts the body portion and the upper gear shaft, and two ends of the button reset member are disposed between and respectively abut the button and the body portion.

In a preferred embodiment, the transmission assembly further comprises a transmission plate, the transmission plate is disposed in the body portion and is configured to move in an up-and-down direction, and the transmission plate is operatively connected between the upper gear shaft and the adjusting member.

In a preferred embodiment, the body portion comprises a housing, a fixed base, a water inlet body, and a water outlet cover. The fixed base, the water inlet body, and the water outlet cover are disposed on the housing. The water inlet passage is defined between the fixed base and the water inlet body. The water outlet cover comprises the plurality of water outlet nozzles. The adjusting member is disposed between the water inlet body and the water outlet cover. The transmission plate is disposed between the fixed base and the water inlet body. A top end of the adjusting member is disposed with a connecting column, and the connecting column is fixedly connected to the transmission plate through the water inlet body. The upper gear shaft is rotatably disposed below the transmission plate and is configured to drive the transmission plate to move upward and downward. A head end of the lower gear shaft downwardly extends out of the water inlet body, and a toothed surface of a rear end of the lower gear shaft is engaged with a toothed surface of the upper gear shaft. A first end of the lower gear shaft reset member abuts the fixed base, and a second end of the lower gear shaft reset member abuts a positioning groove of the upper gear shaft. The button is movably disposed on the water outlet cover, and the button reset member is disposed between and abuts the button and a bottom surface of the water inlet body.

In a preferred embodiment, the ballpoint pen button structure further comprises a guide shaft, a top end of the guide shaft is connected to the fixed base, and a bottom end of the guide shaft passes through the upper gear shaft and is disposed in the lower gear shaft.

In a preferred embodiment, the body portion comprises a housing and a fixed base, and the fixed base is fixedly disposed in the housing. A top end of the adjusting member comprises a transmission column. The fixed base comprises a transmission surface with different heights. A bottom surface of the housing comprises a protruding structure, and the protruding structure comprises an inclined surface. The adjusting member rotates to drive the transmission column to cooperate with the transmission surface with the different heights to enable the adjusting member to move upward and downward along the inclined surface. The transmission column, the transmission surface, and the protruding structure define the transmission assembly.

In a preferred embodiment, the body portion comprises a water dividing plate, and a water outlet cover. The water dividing plate is fixedly disposed in the housing. The water outlet cover is rotatably connected to the housing and is configured to drive the adjusting member to rotate synchronously. The water inlet passage is defined between the housing and the fixed base. The water outlet cover comprises the plurality of water outlet nozzles. The adjusting member is disposed between the water dividing plate and the water outlet cover. A top surface of the fixed base comprises the transmission surface, and the transmission column passes through the water dividing plate to cooperate with the transmission surface.

In a preferred embodiment, the transmission surface comprises a first transmission surface at a first height and a second transmission surface at a second height higher than the first height. When the transmission column cooperates with the first transmission surface, sizes of the adjustable water outlet holes have the first size. When the transmission column cooperates with the second transmission surface, the sizes of the adjustable water outlet holes have the second size.

Compared with the existing techniques, the technical solution has the following advantages.

1. When the adjusting portion moves, sizes of the adjustable water outlet holes can be changed. The water from the water inlet passage flows out of the adjustable water outlet holes with different sizes to define water spray of different strengths. The sizes of the water outlet holes can be changed to define water spray with different strengths by only changing a position of the adjusting portion disposed in the plurality of water outlet nozzles. Water spray with different strengths (e.g., different types) can be achieved without the addition of a water passage, so the design of the shower is smaller and more compact.

2. The ballpoint pen button structure drives the adjusting member to move upward and downward, a transmission structure is simple, and an occupied space is small.

3. The transmission member is driven to move upward and downward due the transmission cooperation between the transmission column and the transmission surface, so the transmission operation is more stable and reliable.

BRIEF DESCRIPTION OF THE DRAWINGS

The present disclosure will be further described below in combination with the accompanying drawings and embodiments.

DETAILED DESCRIPTION OF THE EMBODIMENTS

Embodiment 1

Figure 1:
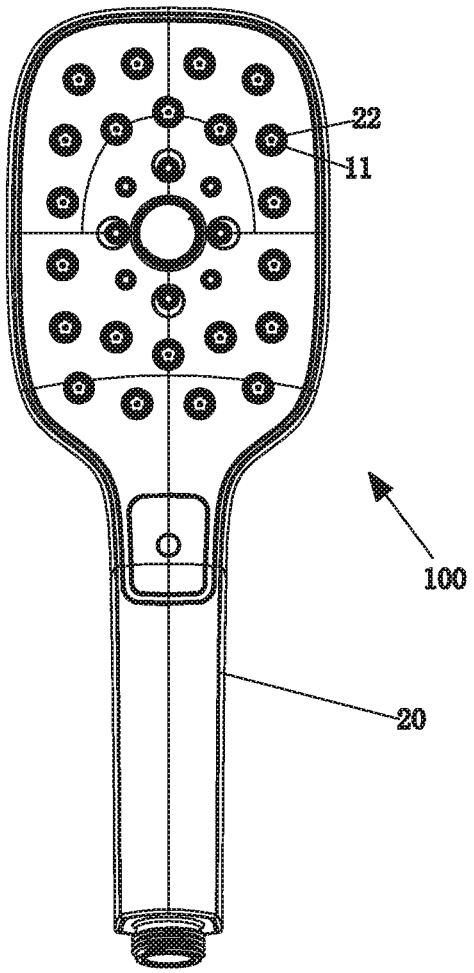
FIG. 1 illustrates an overall view of a shower with an adjustable water spray of Embodiment 1.

Referring to FIGS. 1-7, a shower with an adjustable water spray comprises a body portion 100 and an adjusting member 10.

The body portion 100 comprises a water inlet passage 21 and a plurality of water outlet nozzles 22.

In this embodiment, the body portion 100 comprises a housing 20, a fixed base 30, a water inlet body 40, and a water outlet cover 50. The fixed base 30, the water inlet body 40, and the water outlet cover 50 are fixedly disposed on the housing 20. The water inlet passage 21 is defined between the fixed base 30 and the water inlet body 40, and the plurality of water outlet nozzles 22 are disposed on the water outlet cover 50.

Figure 2:
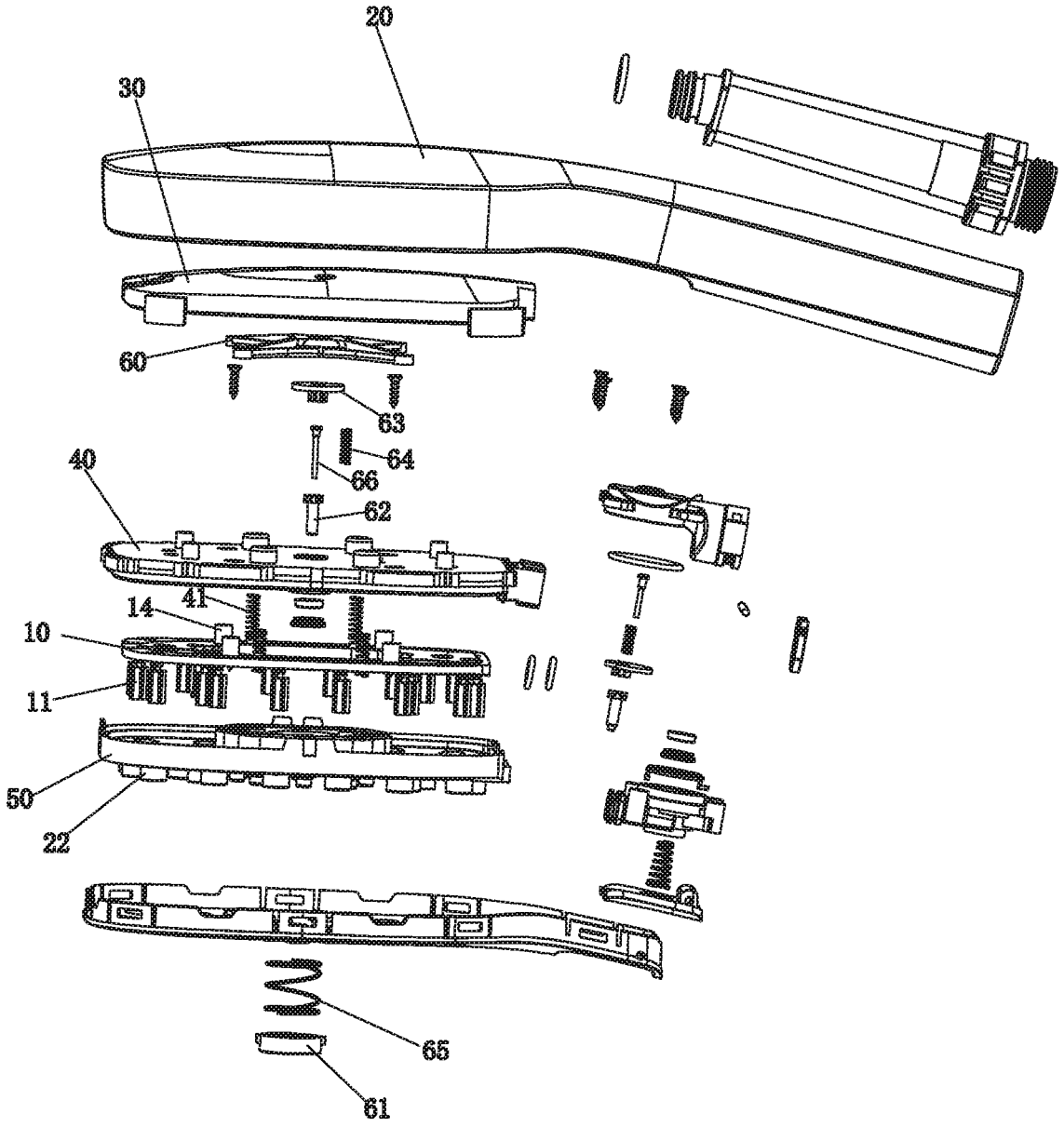
FIG. 2 illustrates an exploded perspective view of the shower with the adjustable water spray of Embodiment 1.
Figure 7:
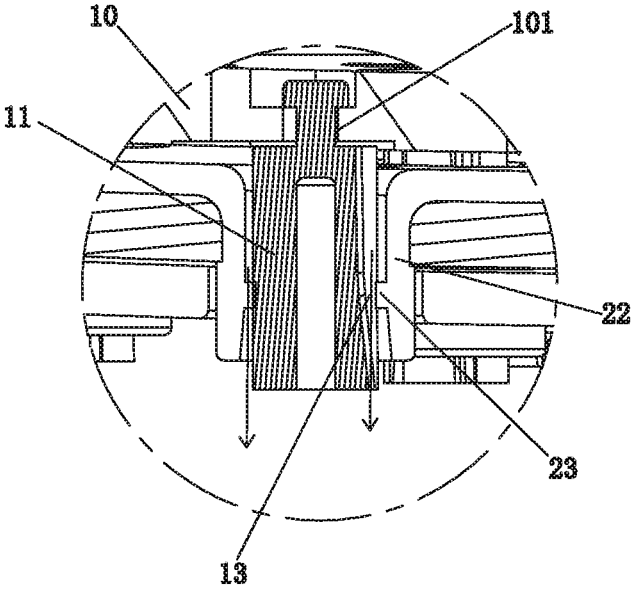
FIG. 7 illustrates a partial enlarged view of FIG. 3.
Figure 8:
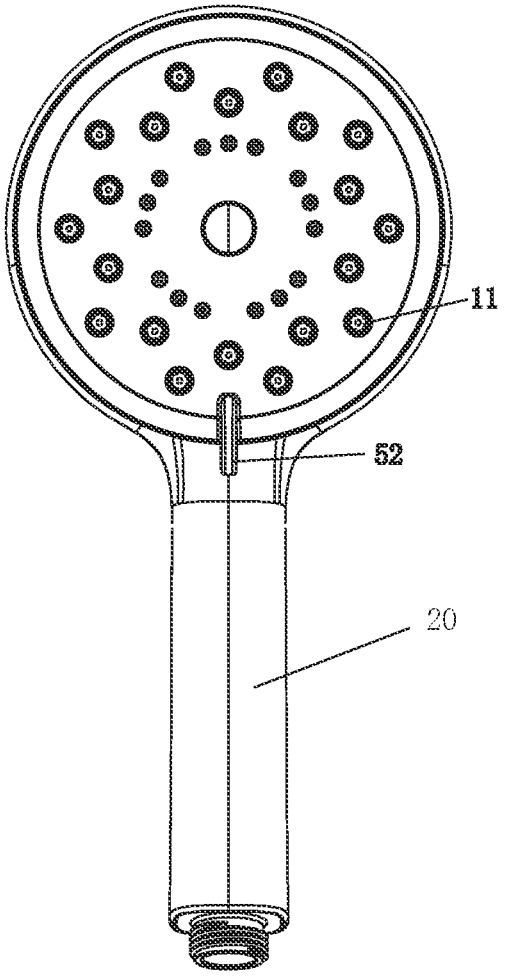
FIG. 8 illustrates an overall view of a shower with an adjustable water spray of Embodiment 2.

The adjusting member 10 is movably disposed in the body portion 100, and the adjusting member 10 comprises a plurality of adjusting portions 11. An outer side of each of the plurality of adjusting portions 11 is disposed with a plurality of adjusting grooves 12 extending longitudinally, and a size of each of the plurality of adjusting grooves 12 gradually reduces in a downward direction (e.g., an top-to-bottom direction). An inner wall of each of the plurality of water outlet nozzles 22 comprises a sealing portion 23. Each of the plurality of adjusting portion 11 extends into a corresponding one of the plurality of water outlet nozzles 22 and hermetically and movably cooperates with a corresponding one of the sealing portions 23, so that the plurality of adjusting grooves 12 of each of the plurality of adjusting portion 11 and a corresponding one of the sealing portions 23 define an adjustable water outlet hole 13. Sizes of the adjustable water outlet holes 13 can be changed when the plurality of adjustment portions 11 move. Water from the water inlet passage 21 flows out of the adjustable water outlet holes 13 with different sizes to define water sprays with different strengths. Referring to FIG. 2, the adjusting member 10 and the plurality of adjusting portions 11 are separated, and the adjusting member 10 has a hollow plate shape. The adjusting member 10 comprises lock holes 101, and the number of the lock holes 101 is the same as the number of the adjusting portions 11. A top end of each of the plurality of adjusting portions 11 comprises a protruding column 111 and a protruding platform 112 fixedly connected to the protruding column 111. Referring to FIG. 7, the protruding columns 111 are disposed in the lock holes 101, and the protruding platforms 112 abut upper end surfaces of the lock holes 101 to enable the plurality of adjusting portions 11 to be fixedly connected to the adjusting member 10.

In this embodiment, each of the plurality of adjusting portions 11 is a cylinder, and the plurality of adjusting grooves 12 are annularly disposed at intervals on the outer side of each of the plurality of adjusting portions 11. The sealing portions 23 are annular gaskets, and each of the annular gaskets hermetically surrounds an outer side of a corresponding one of the plurality of adjusting portions 11.

In this embodiment, the adjusting member 10 is disposed between the water inlet body 40 and the water outlet cover 50. A top end of the adjusting member 10 comprises a connecting column 14 configured to pass through the water inlet body 40 and to be fixedly connected to a transmission plate 60. Referring to FIG. 2, the connecting column 14 is locked to the transmission plate 60 by screws. Further, a reset spring 41 of the adjusting member 10 is disposed between the adjusting member 10 and the water inlet body 40.

In this embodiment, the shower further comprises a transmission assembly, and the transmission assembly is operatively connected to the adjusting member 10 to drive the adjusting member 10 to move upward and downward.

In this embodiment, the transmission assembly comprises a ballpoint pen button structure disposed on the body portion 100, the ballpoint pen button structure comprises a button 61, a lower gear shaft 62, an upper gear shaft 63, a lower gear shaft reset member 64, and a button reset member 65. The button 61 is operatively engaged with the lower gear shaft 62. The lower gear shaft 62 is operatively engaged with the upper gear shaft 63. The upper gear shaft 63 is operatively engaged with the adjusting member 10. The lower gear shaft reset member 64 is disposed between and abuts the body portion 100 and the lower gear shaft 62, and two ends of the button reset member 65 are disposed between and respectively abut the button 61 and the body portion 100. Moreover, the water inlet body 40 comprises ribs (not shown in the Figs.), and the upper gear shaft 63 cooperates with the ribs to enable the upper gear shaft 63 to move upward and downward. The aforementioned structure is a conventional structure of existing ballpoint pen button structures.

In this embodiment, the transmission assembly further comprises the transmission plate 60. The transmission plate 60 is disposed in the body portion 100 and is configured to move in an up-and-down direction (e.g., in a vertical direction). The transmission plate 60 is operatively connected between the upper gear shaft 63 and the adjusting member 10. In this embodiment, the transmission plate 60 is disposed between the fixed base 30 and the water inlet body 40.

Figure 3:
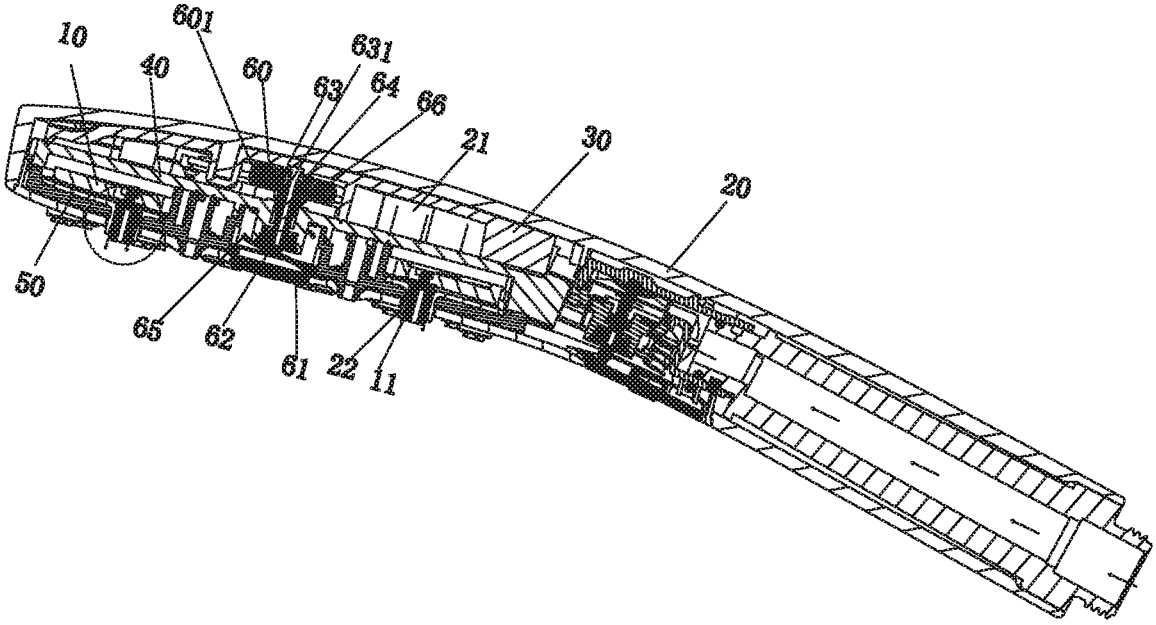
FIG. 3 illustrates a cross-sectional view of the shower with the adjustable water spray of Embodiment 1 when a size of an adjustable water outlet hole is enlarged.

In this embodiment, the upper gear shaft 63 is rotatably disposed below the transmission plate 60 and is configured to drive the transmission plate 60 to move upward and downward. A head end of the lower gear shaft 62 downwardly extends out of the water inlet body 40, and a toothed surface of a rear end of the lower gear shaft 62 is engaged with a toothed surface of the upper gear shaft 63. A first end of the lower gear shaft reset member 64 abuts the fixed base 30, and a second end of the lower gear shaft reset member 64 abuts a positioning groove 631 of the upper gear shaft 63. The button 61 is movably disposed on the water outlet cover 50, and the button reset member 65 is disposed between and abuts the button 61 and a bottom surface of the water inlet body 40. Referring to FIG. 3, a bottom end of the transmission plate 60 comprises a rotation groove 601. The upper gear shaft 63 is rotatably engaged with the rotation groove 601, and the upper gear shaft 63 moves upward and downward to drive the transmission plate 60 to move upward and downward.

In this embodiment, the ballpoint pen button structure further comprises a guide shaft 66. A top end of the guide shaft 66 is connected to the fixed base 30, and a bottom end of the guide shaft 66 passes through the upper gear shaft 63 and is disposed in (i.e., extends into) the lower gear shaft 62.

Figure 4:
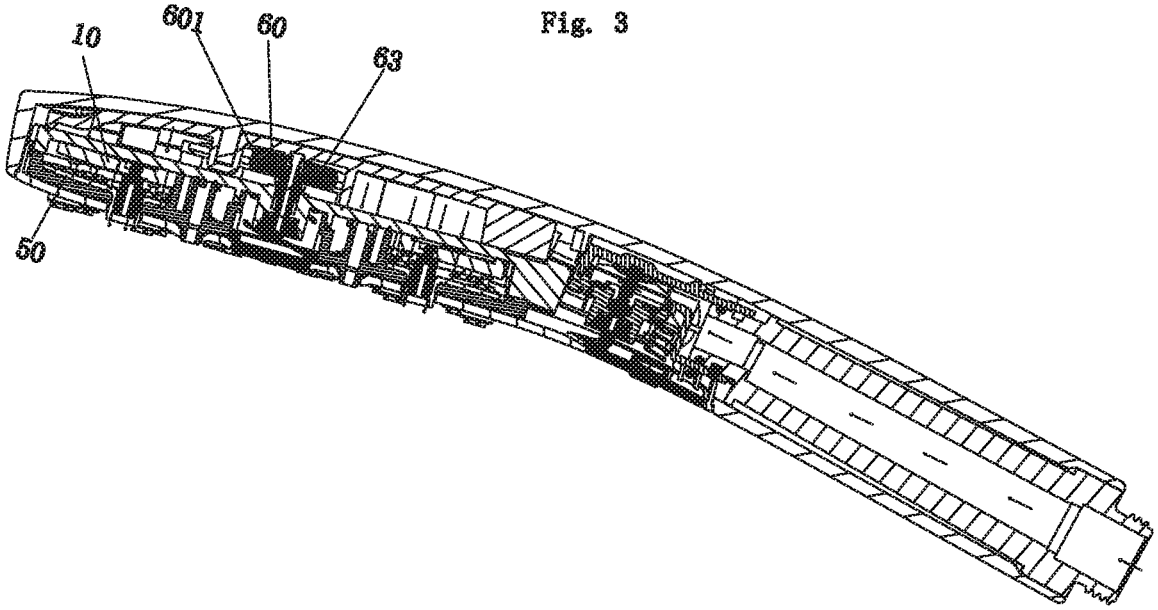
FIG. 4 illustrates a cross-sectional view of the shower with the adjustable water spray of Embodiment 1 when the size of the adjustable water outlet hole is reduced.
Figure 5:
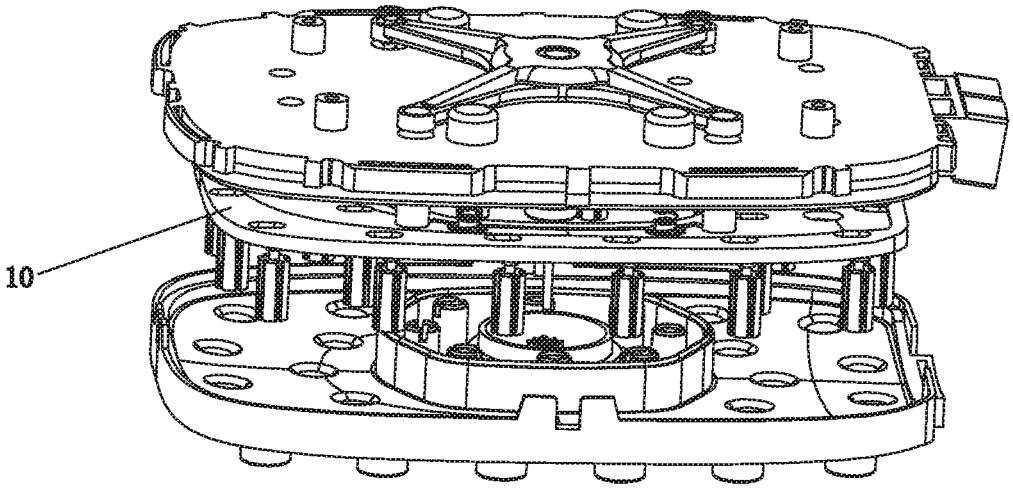
FIG. 5 illustrates a perspective view of an assembly of a transmission plate, a water inlet body, an adjusting member, and a water outlet cover of Embodiment 1.
Figure 6:
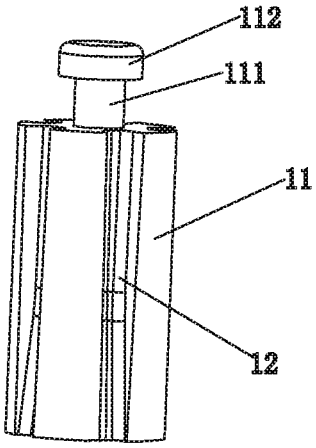
FIG. 6 illustrates a perspective view of an adjusting portion of Embodiment 1.

The working principle of the ballpoint pen button structure is conventional, that is, the button 61 is pressed to drive the adjusting member 10 to be switched between two heights. Referring to FIG. 3, when the adjusting member 10 is at a lower position, the sizes of the adjustable water outlet holes 13 are enlarged, and a water spray strength is weak. Referring to FIG. 4, when the adjusting member 10 is at a higher position, the sizes of the adjustable water outlet holes 13 are reduced, and the water spray strength is strong.

The specific adjustment process is as follows.

Referring to FIG. 3, in an initial state, the adjusting member 10 is at the lower position, the sizes of the adjustable water outlet holes 13 are enlarged, and the water from the water inlet passage 21 flows out of the adjustable water outlet holes 13 to define a weak water spray strength.

The button 61 is pressed to drive the lower gear shaft 62 to move upward, the lower gear shaft 62 drives the upper gear shaft 63 to rotate and cooperates with the upper gear shaft 63 by the ribs to enable the upper gear shaft 63 to move upward, and the upper gear shaft 63 drives the transmission plate 60 to move upward and further to drive the adjusting member 10 to move upward. At this time, the adjusting member 10 is at the higher position. Referring to FIG. 4, the sizes of the adjustable water outlet holes 13 are reduced to define a strong water spray strength.

The button 61 is pressed again to reset to the initial state, and thus the shower returns to the state shown in FIG. 3.

Embodiment 2

Referring to FIGS. 8-13, a shower with an adjustable water spray is provided. This embodiment differs from Embodiment 1 in that a structure of the transmission assembly is different.

Figure 9:
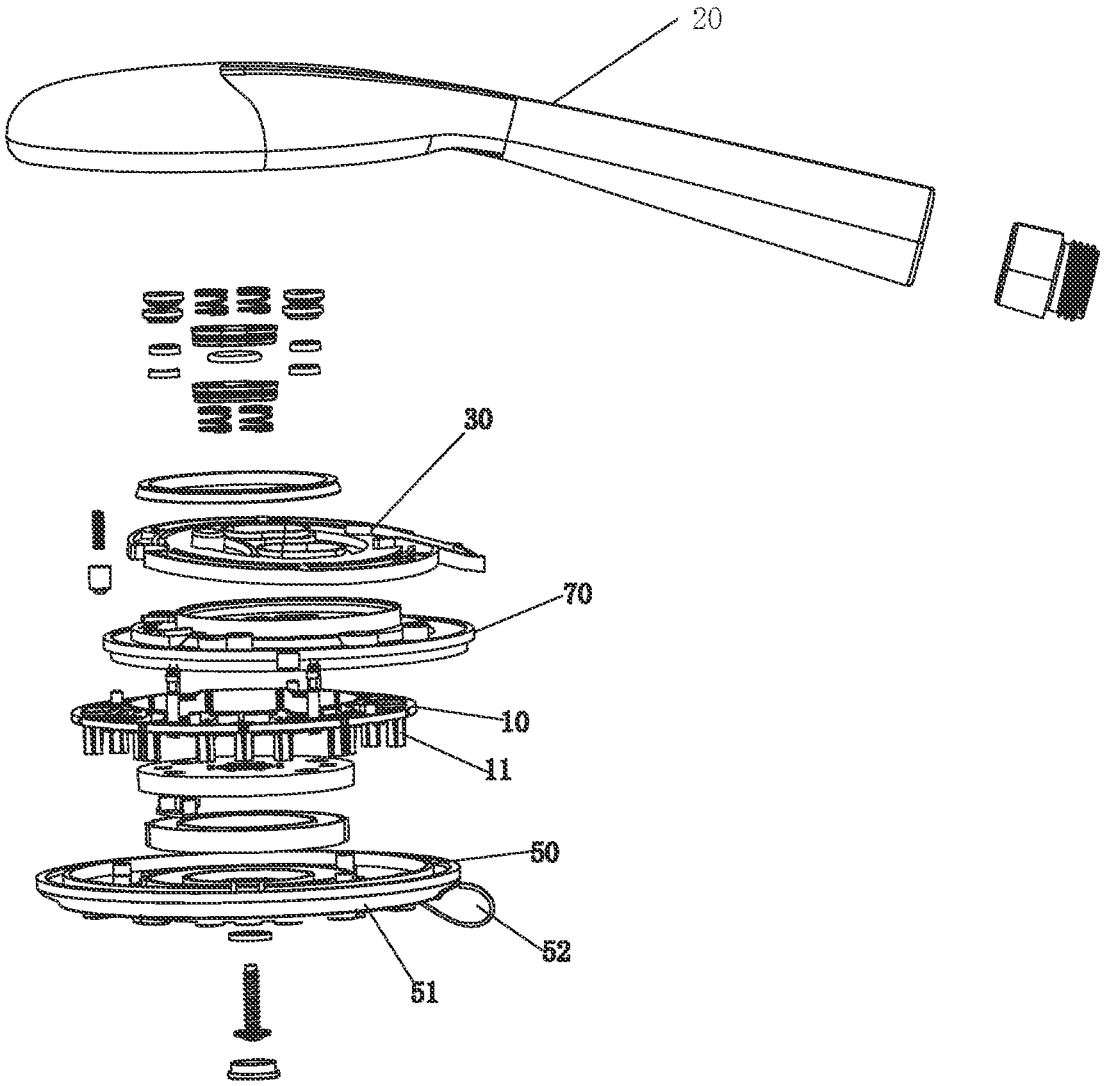
FIG. 9 illustrates an exploded perspective view of the shower with the adjustable water spray of Embodiment 2.
Figure 10:
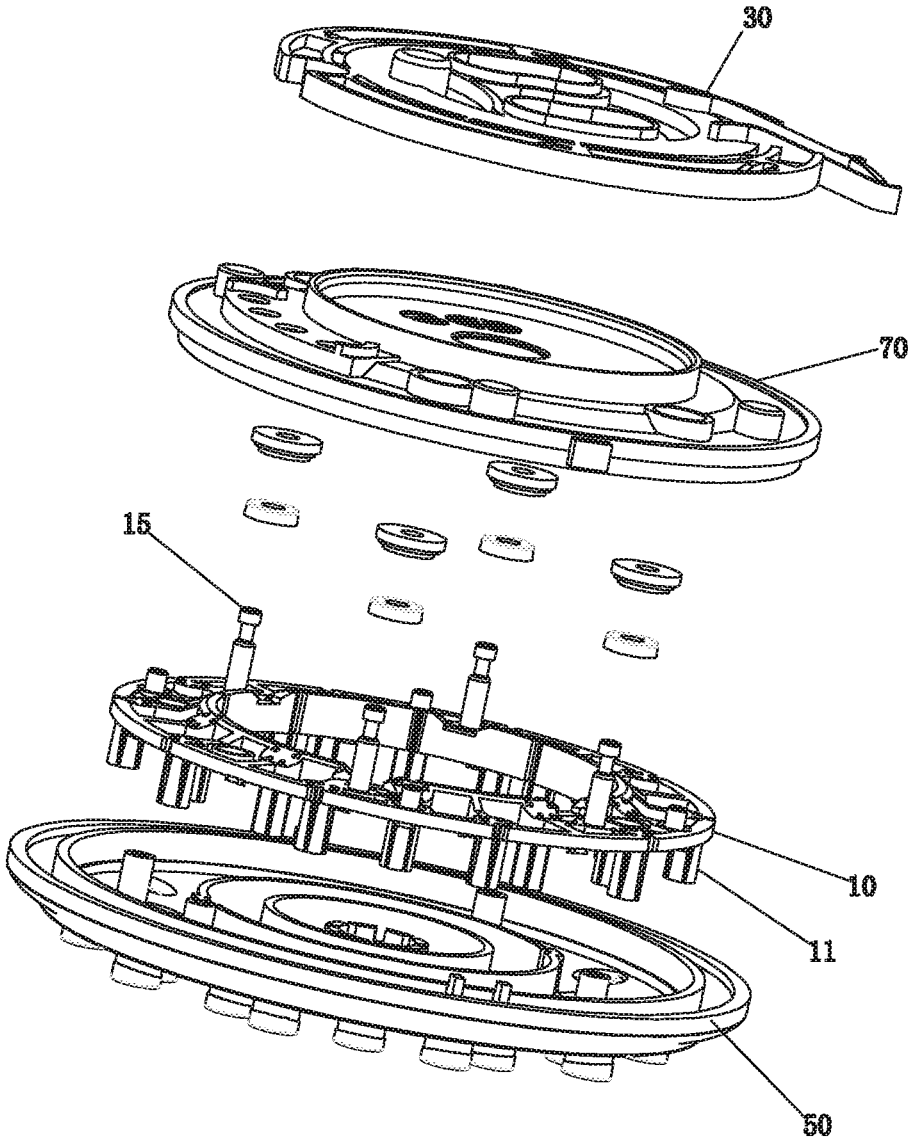
FIG. 10 illustrates a perspective view of an assembly of a fixed base, a water dividing plate, an adjusting member, and a water outlet cover of Embodiment 2.
Figure 11:
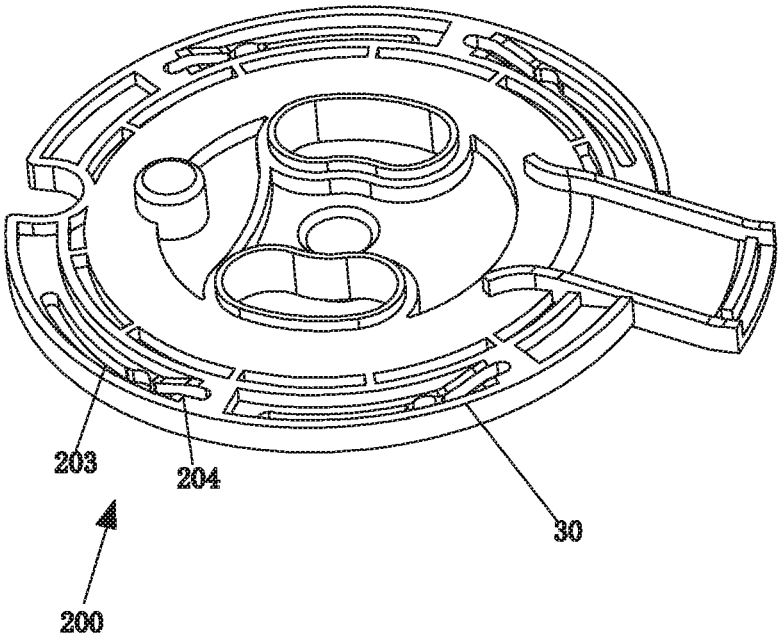
FIG. 11 illustrates a perspective view of the fixed base of Embodiment 2.

In this embodiment, the top end of the adjusting member 10 comprises one or more transmission columns 15, and the body portion 100 comprises one or more transmission surfaces 200 at different heights. The adjusting member 10 rotates to drive the one or more transmission columns 15 to cooperate with the one or more transmission surfaces 200 at different heights to enable the adjusting member 10 to move upward and downward. The one or more transmission columns 15 and the one or more transmission surfaces 200 define the transmission assembly. Referring to FIG. 9, the one or more transmission columns 15 comprises four transmission columns 15, and the four transmission columns 15 are annularly disposed at intervals. Referring to FIG. 11, the one or more transmission surfaces 200 also comprises four groups of transmission surfaces 200, and the four groups of transmission surfaces 200 are annularly disposed at intervals.

In this embodiment, each group of the four groups of the transmission surfaces 200 comprises a first transmission surface 203 having a lower height and a second transmission surface 204 having a higher height. When the transmission columns 15 are engaged with the first transmission surfaces 203, the sizes of the adjustable water outlet holes 13 are enlarged. When the transmission columns 15 are engaged with the second transmission surfaces 204, the sizes of the adjustable water outlet holes 13 are reduced. As desired, each group of the four groups of the transmission surfaces 200 can also comprise three or four transmission surfaces 200 at different heights to define a variety of water spray strengths, and the disclosure is not limited to a certain number of transmission surfaces 200 being disposed within each group.

In this embodiment, the body portion 100 comprises the housing 20, the fixed base 30, the water dividing plate 70, and the water outlet cover 50. The fixed base 30 and the water dividing plate 70 are fixedly disposed in the housing 20. The water outlet cover 50 is rotatably connected to the housing 20 and is configured to drive the adjusting member 10 to rotate synchronously. The water inlet passage 21 is defined between the housing 20 and the fixed base 30. The water outlet cover 50 comprises the plurality of water outlet nozzles 22. The adjusting member 10 is disposed between the water dividing plate 70 and the water outlet cover 50. A top surface of the fixed base 30 comprises the one or more transmission surfaces 200. The one or more transmission columns 15 pass through the water dividing plate 70 to cooperate with the one or more transmission surfaces 200. Referring to FIG. 9, an outer side of the water outlet cover 50 is further disposed with a decorative cover 51. The decorative cover 51 is disposed with a dialing block 52. The dialing block 52 is configured to be rotated to drive the decorative cover 51 and the water outlet cover 50 to rotate, thereby driving the adjusting member 10 to rotate synchronously.

Figure 14:
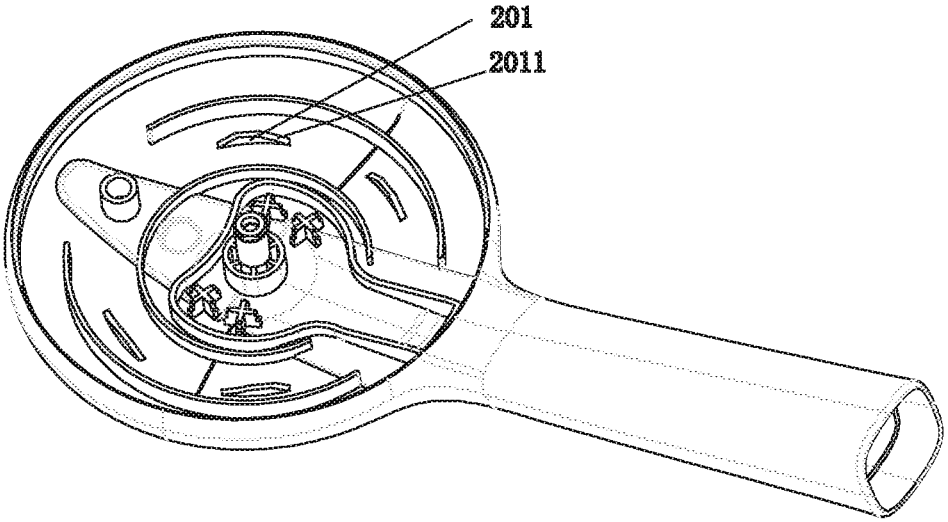
FIG. 14 illustrates a perspective view of a housing of the shower with the adjustable water spray of Embodiment 2.

A bottom surface of the housing 20 comprises one or more protruding structures 201. Referring to FIG. 14, the one or more protruding structures 201 also comprises four groups of protruding structures 201, and the four groups of protruding structures 201 are annularly disposed at intervals. Each group of the four groups of protruding structures 201 comprises an inclined surface 2011.

The working principle of this embodiment is as follows.

Figure 12:
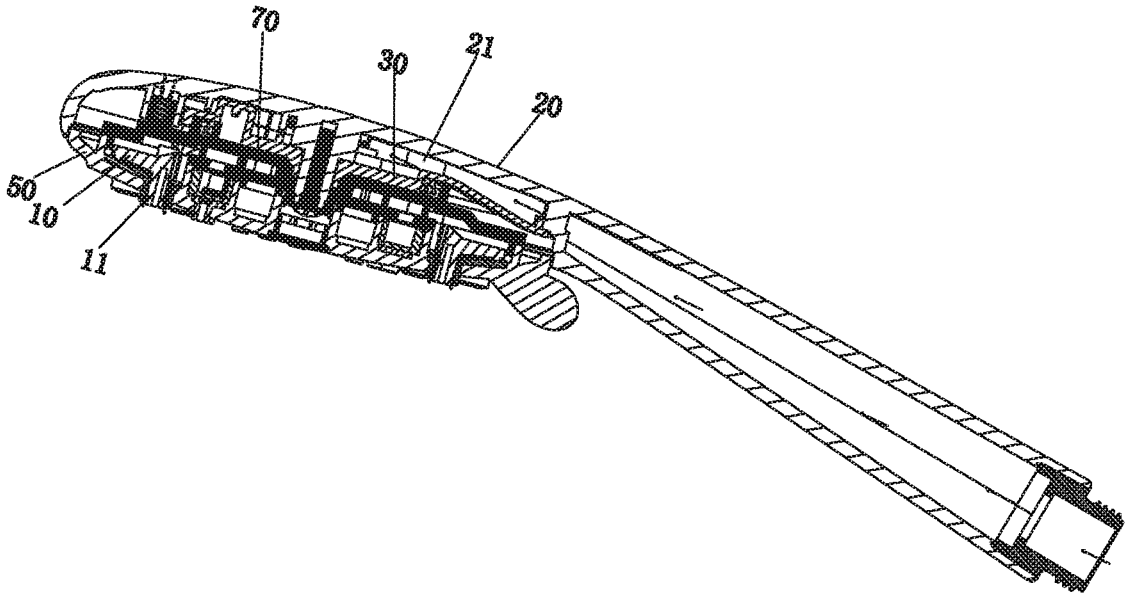
FIG. 12 illustrates a cross-sectional view of the shower with the adjustable water spray of Embodiment 2 when a size of an adjustable water outlet hole is enlarged.

Referring to FIG. 12, in an initial state, the one or more transmission columns 15 cooperate with the first transmission surface 203, the adjusting member 10 is at the lower position, the sizes of the plurality of adjustable water outlet holes 13 are enlarged, and the water from the water inlet passage 21 flows out of the adjustable water outlet holes 13 to define a weak water spray strength.

Figure 13:
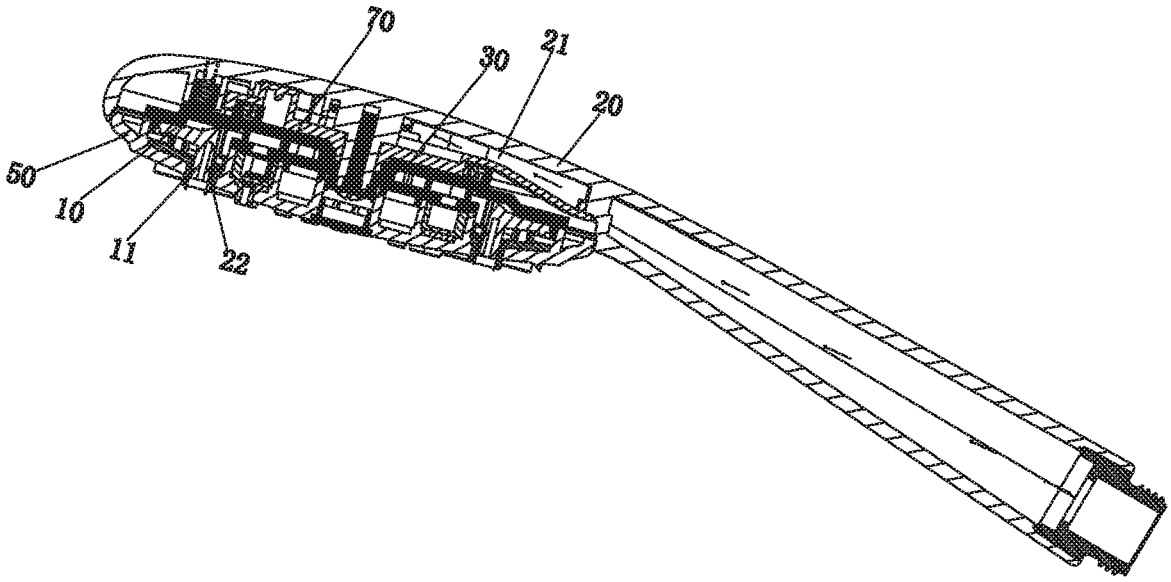
FIG. 13 illustrates a cross-sectional view of the shower with the adjustable water spray of Embodiment 2 when the size of the adjustable water outlet hole is reduced.

The dialing block 52 rotates to drive the decorative cover 51 and the water outlet cover 50 to rotate so as to drive the adjusting member 10 to rotate synchronously, so that the one or more transmission columns 15 cooperate with the second transmission surfaces 204. Since the fixed base 30 remains fixed, the adjusting member 10 moves upward along the first inclined surfaces 2011. Referring to FIG. 13, at this time, the sizes of the adjustable water outlet holes 13 are reduced, and the water from the water inlet passage 21 flows out of the adjustable water outlet holes 13 to define a strong water spray strength.

The dialing block 52 rotates reversely (e.g., counterclockwise) to drive the decorative cover 51 and the water outlet cover 50 to rotate so as to drive the adjusting member 10 to rotate synchronously, the four groups of protruding structures 201 drive the transmission columns 15 to move downward along the inclined surfaces 2011, and then the adjusting member 10 moves downward.

It will be apparent to those skilled in the art that various modifications and variation can be made in the present disclosure without departing from the spirit or scope of the invention. Thus, it is intended that the present disclosure cover the modifications and variations of this invention provided they come within the scope of the appended claims and their equivalents.

What is claimed is:

1. A shower with an adjustable water spray, comprising:

a body portion comprising a water inlet passage and a plurality of water outlet nozzles, a transmission assembly, and an adjusting member, wherein:

the adjusting member is movably disposed in the body portion, the adjusting member comprises a plurality of adjusting portions, an outer side of each of the plurality of adjusting portions comprises a plurality of adjusting grooves extending longitudinally, a size of each of the plurality of adjusting grooves gradually reduces in a downward direction, an inner wall of each of the plurality of water outlet nozzles comprises a sealing portion, each of the plurality of adjusting portions extends into a corresponding one of the plurality of water outlet nozzles and hermetically and movably cooperates with a corresponding one of the sealing portions, the plurality of adjusting grooves of each of the plurality of adjusting portions and a corresponding one of the sealing portions defines an adjustable water outlet hole, each of the plurality of adjusting portions is a cylinder, the plurality of adjusting grooves are annularly disposed at intervals on the outer side of each of the plurality of adjusting portions, the sealing portions are annular gaskets, each of the annular gaskets hermetically surrounds the outer side of a corresponding one of the plurality of adjusting portions, the transmission assembly is operatively connected to the adjusting member to drive the adjusting member to move upward and downward, the transmission assembly comprises a ballpoint pen button structure disposed on the body portion, the ballpoint pen button structure comprises a button, a lower gear shaft, an upper gear shaft, a lower gear shaft reset member, and a button reset member, the button is operatively engaged with the lower gear shaft, the lower gear shaft is operatively engaged with the upper gear shaft, the upper gear shaft is operatively engaged with the adjusting member, the lower gear shaft reset member is disposed between and abuts the body portion and the upper gear shaft, two ends of the button reset member are disposed between and respectively abut the button and the body portion, when the plurality of adjusting portions move to a first position:

the adjustable water outlet holes have a first size, and water from the water inlet passage flows out of the adjustable water outlet holes to define a water spray having a first strength, and when the plurality of adjusting portions move to a second position:

the adjustable water outlet holes have a second size, and the water from the water inlet passage flows out of the adjustable water outlet holes to define a water spray having a second strength different than the first strength.

2. The shower with the adjustable water spray according to claim 1, wherein:

the transmission assembly further comprises a transmission plate, the transmission plate is disposed in the body portion and is configured to move in an up-and-down direction, and the transmission plate is operatively connected between the upper gear shaft and the adjusting member.

3. The shower with adjustable water spray according to claim 2, wherein:

the body portion comprises a housing, a fixed base, a water inlet body, and a water outlet cover, the fixed base, the water inlet body, and the water outlet cover are disposed on the housing, the water inlet passage is defined between the fixed base and the water inlet body, the water outlet cover comprises the plurality of water outlet nozzles, the adjusting member is disposed between the water inlet body and the water outlet cover, the transmission plate is disposed between the fixed base and the water inlet body, a top end of the adjusting member is disposed with a connecting column, the connecting column is fixedly connected to the transmission plate through the water inlet body, the upper gear shaft is rotatably disposed below the transmission plate and is configured to drive the transmission plate to move upward and downward, a head end of the lower gear shaft downwardly extends out of the water inlet body, a toothed surface of a rear end of the lower gear shaft is engaged with a toothed surface of the upper gear shaft, a first end of the lower gear shaft reset member abuts the fixed base, a second end of the lower gear shaft reset member abuts a positioning groove of the upper gear shaft, the button is movably disposed on the water outlet cover, and the button reset member is disposed between and abuts the button and a bottom surface of the water inlet body.

4. The shower with adjustable water spray according to claim 3, wherein:

the ballpoint pen button structure further comprises a guide shaft, a top end of the guide shaft is connected to the fixed base, and a bottom end of the guide shaft passes through the upper gear shaft and is disposed in the lower gear shaft.

5. A shower with an adjustable water spray, comprising:

a body portion comprising a water inlet passage and a plurality of water outlet nozzles, a transmission assembly, and an adjusting member, wherein:

the adjusting member is movably disposed in the body portion, the adjusting member comprises a plurality of adjusting portions, an outer side of each of the plurality of adjusting portions comprises a plurality of adjusting grooves extending longitudinally, a size of each of the plurality of adjusting grooves gradually reduces in a downward direction, an inner wall of each of the plurality of water outlet nozzles comprises a sealing portion, each of the plurality of adjusting portions extends into a corresponding one of the plurality of water outlet nozzles and hermetically and movably cooperates with a corresponding one of the sealing portions, the plurality of adjusting grooves of each of the plurality of adjusting portions and a corresponding one of the sealing portions defines an adjustable water outlet hole, each of the plurality of adjusting portions is a cylinder, the plurality of adjusting grooves are annularly disposed at intervals on the outer side of each of the plurality of adjusting portions, the sealing portions are annular gaskets, each of the annular gaskets hermetically surrounds the outer side of a corresponding one of the plurality of adjusting portions, the transmission assembly is operatively connected to the adjusting member to drive the adjusting member to move upward and downward, the body portion comprises a housing and a fixed base, the fixed base is fixedly disposed in the housing, a top end of the adjusting member comprises a transmission column, the fixed base comprises a transmission surface with different heights, a bottom surface of the housing comprises a protruding structure, the protruding structure comprises an inclined surface, the adjusting member rotates to drive the transmission column to cooperate with the transmission surface with the different heights to enable the adjusting member to move upward and downward along the inclined surface, the transmission column, the transmission surface, and the protruding structure define the transmission assembly, when the plurality of adjusting portions move to a first position:

the adjustable water outlet holes have a first size, and water from the water inlet passage flows out of the adjustable water outlet holes to define a water spray having a first strength, and when the plurality of adjusting portions move to a second position:

the adjustable water outlet holes have a second size, and the water from the water inlet passage flows out of the adjustable water outlet holes to define a water spray having a second strength different than the first strength.

6. The shower with adjustable water spray according to claim 5, wherein:

the body portion comprises a water dividing plate and a water outlet cover, the water dividing plate is fixedly disposed in the housing, the water outlet cover is rotatably connected to the housing and is configured to drive the adjusting member to rotate synchronously, the water inlet passage is defined between the housing and the fixed base, the water outlet cover comprises the plurality of water outlet nozzles, the adjusting member is disposed between the water dividing plate and the water outlet cover, a top surface of the fixed base comprises the transmission surface, and the transmission column passes through the water dividing plate to cooperate with the transmission surface.

7. The shower with adjustable water spray according to claim 6, wherein:

the transmission surface comprises a first transmission surface at a first height and a second transmission surface at a second height higher than the first height, when the transmission column cooperates with the first transmission surface, the adjustable water outlet holes have the first size, and when the transmission column cooperates with the second transmission surface, the adjustable water outlet holes have the second size.

* * * * *